United States Patent [19]

Simpson

[11] Patent Number: 4,495,753

[45] Date of Patent: Jan. 29, 1985

[54] CONTROL HALTER

[75] Inventor: Roy G. Simpson, Cookeville, Tenn.

[73] Assignee: Adams Plastics, Inc., Cookeville, Tenn.

[21] Appl. No.: 514,164

[22] Filed: Jul. 15, 1983

[51] Int. Cl.[3] ..... B68B 1/02

[52] U.S. Cl. ..... 54/24

[58] Field of Search ..... 54/6 R, 6 A, 12, 14, 54/15, 24, 35, 71

[56] References Cited

U.S. PATENT DOCUMENTS

| | | | |
|---|---|---|---|
| 1,278,021 | 9/1918 | Robinson | 54/24 |
| 1,333,474 | 3/1920 | De France | 54/15 |
| 2,572,517 | 10/1951 | Ratliff | 54/15 X |
| 2,652,671 | 9/1953 | Griffiths | 54/6 R |
| 3,906,707 | 9/1975 | Morgan | 54/35 |
| 3,949,538 | 4/1976 | Woodruff | 54/24 |
| 3,998,033 | 12/1976 | Watkins et al. | 54/6 R |

*Primary Examiner*—Robert P. Swiatek

*Attorney, Agent, or Firm*—Luedeka & Neely

[57] ABSTRACT

The specification discloses a control halter to be used beneath a bridle to develop and maintain correct head set in a riding or performance horse. The control halter is connected to a tie-down which is in turn connected to a breast collar or the cinch of the saddle. The control halter includes a loose fitting nosepiece for being disposed high on the nose of the horse, and a keeper strap encircles the head and neck of the horse. Two connecting pieces extend from the top of the nosepiece to the top of the keeper strap, passing closely by the inside of each ear of the horse. The tie-down is attached to a loop on the nosepiece. When the horse attempts to raise its head, the martingale pulls on the control halter and the same amount of pressure is applied over the ears as is applied high on the nose. The halter is dimensioned so that lateral control of the horse is not hampered by the halter while proper head set is maintained.

10 Claims, 4 Drawing Figures

CONTROL HALTER

The present invention relates to horse tack and particularly relates to a control halter for use in conjunction with a tie-down for developing and maintaining correct head set in a riding or performance horse.

The development and maintenance of the correct head set in a riding horse is very important. The horse uses its head and neck to balance itself and must have his eyes in good position to see where it is going. Horses often have a tendency to excessively raise their heads or to extend their heads too far forwardly. This behavior may have undesirable effects on the performance and safety of the horse.

Many types of devices have been used for the development and maintenance of correct head set. Various types of martingales and draw reins have been used to train a horse to hold its head in the proper position or to maintain proper head position. Martingales are generally connected at one end to the cinch of the saddle or to the breast collar and the other end connects either to the reins or to a nosepiece on the bridle. A standing martingale or tie-down is a single strap running from the cinch or breast collar to a nose band, bosal or halter on the horse's head. Tie-downs are sometimes ineffective because they interfere with lateral control, that is, the horse is restrained from moving his head laterally as well as the intended vertical and forward restraint. Moreover, since the tie-down is generally attached only to a nose band at a position where the horse is not particularly sensitive, a tie-down is not particularly effective for developing and maintaining correct head set.

Thus, a need has arisen for a control halter for use with a tie-down which is more effective in the development and maintenance of correct head set. A device is needed which can apply pressure to a more sensitive area on the horse's head such as the area close to the ears and the brow area. In addition, the control halter should be operable for use underneath a standard bridle and bit and should minimize interference with lateral control of the horse.

In accordance with one form of the present invention, there is provided a control halter for use in conjunction with a tie-down to develop and maintain correct head set in a riding horse. The control halter includes a nosepiece connected to the tie-down for being disposed high on the nose of the horse and a keeper strap about the horse's head and neck. The nosepiece and the keeper strap are connected by a connecting mechanism which is operable to apply the same amount of pressure to the horse's head over the ears and high on the nose when the horse raises its head or moves its head forward.

In accordance with a more particular form of the present invention, there is provided a control halter for use in conjunction with a tie-down to develop and maintain proper head set in a riding horse which includes a loose-fitting nosepiece for being disposed high on the nose of the horse. A keeper strap is disposed about the horse's head and neck and extends over the poll of the horse and under the throttle of the horse. Two connecting pieces extend between the top of the nosepiece and the top of the keeper strap. Each of the connecting pieces extend from the nosepiece along the horse's face and along the inside of the one of the horse's ears to the keeper strap.

The keeper strap is preferably made from a woven strap fastened by a double-edge strap buckle. The strap buckle is operable to secure the woven strap in a circuitous configuration around the horse's head and neck. The nosepiece and the connecting pieces are preferably made from flexible metal cable having a resilient covering, and the connecting pieces are formed from a unitary length of such flexible metal cable. The length of flexible metal cable is doubled back at its midsection and is secured by first cable clamp to form a loop. The loop is fastened to the nosepiece by a second cable clamp which secures lowermost portion of the loop and the uppermost portion of the nosepiece in a substantially parallel relationship.

The present invention may best be understood by reference to the following detailed description when considered in conjunction with the accompanying drawings in which.

Figure 1:
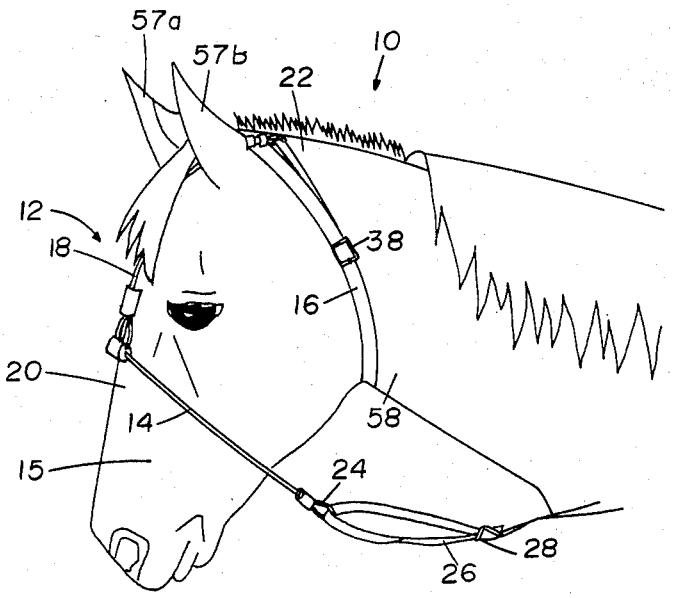
FIG. 1 is a perspective view of a horse's head onto which one form of the control halter embodying the present invention has been fitted.

Referring now to the drawings in which like reference characters designate like or corresponding parts throughout the several views, there is shown in FIG. 1, a perspective view of a horse's head 10 on which one form of the control halter 12 embodying the present invention has been fitted. The control halter 12 includes a loose-fitting nosepiece 14 disposed high on the nose 15 of the horse and an adjustable keeper strap 16 fitted about the horse's head and neck. A connecting mechanism 18 connects between the nosepiece 14 and the keeper strap 16. The connecting mechanism 18 extends from the nosepiece 14 along the face 20 of the horse over the poll 22 to the keeper strap 16. A nosepiece loop 24 is used to connect the control halter 12 to a tie-down 26 by means of a conway buckle 28, or other such fastening device. The tie-down 26 is attached either to a breast collar or the cinch of the saddle, not shown.

Figure 2:
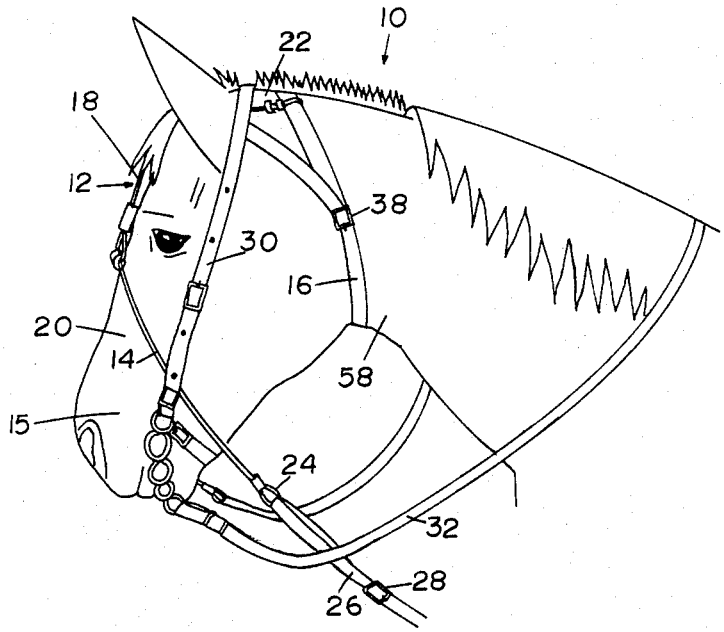
FIG. 2 is a perspective view of a horse's head onto which the control halter of the present invention has been fitted and further showing a bridle fitted over the control halter.

Referring now to FIG. 2, there is shown a horse's head 10 onto which is fitted a control halter 12. A bridle and bit 30 are shown fitted over the control halter 12, and the tie-down 26 passes between the reins 32 and connects to the control halter 12.

Figure 3:
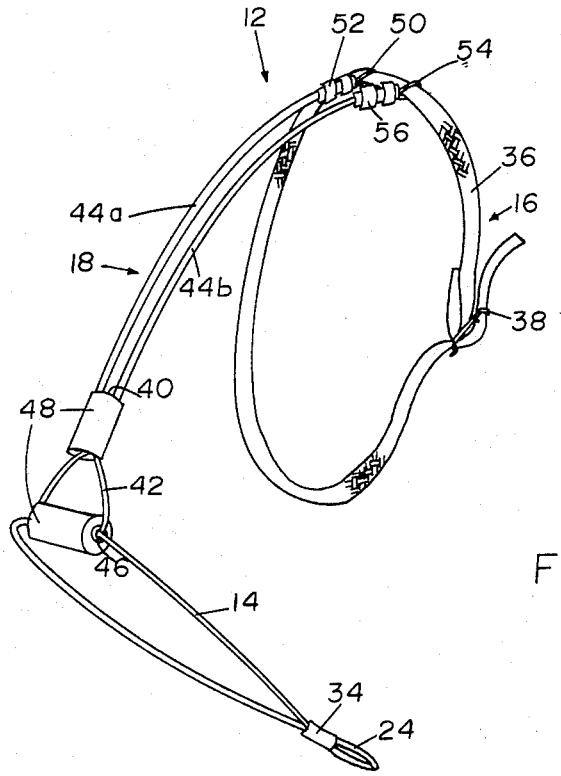
FIG. 3 is a perspective view of a control halter of the present invention.

Referring now to FIG. 3, the control halter 12 embodying one form of the present invention is shown. The nosepiece 14 is dimensioned to fit loosely about the nose 15 of the horse in a position high on the nose 15. The nosepiece 14 is made from an endless ring of flexible metal cable covered by a resilient covering. The diameter of the flexible metal cable with the covering is approximately three-sixteenths inches. The nosepiece loop 24 is formed at the lowermost portion of the nosepiece 14 by drawing the flexible cable together to produce the loop 24 with two portions of the flexible cable being held together in a parallel relationship. A first clamp 34 secures the parallel portions of the cable together. In this preferred embodiment, the endless ring of flexible metal cable forming the nosepiece 14 is a unitary length of flexible metal cable. Thus, the first clamp 34 also secures the ends of the unitary length together to produce the endless loop. The keeper strap 16 is made from a woven strap 36 held in a circuitous configuration by a double-ended strap buckle 38.

Figure 4:
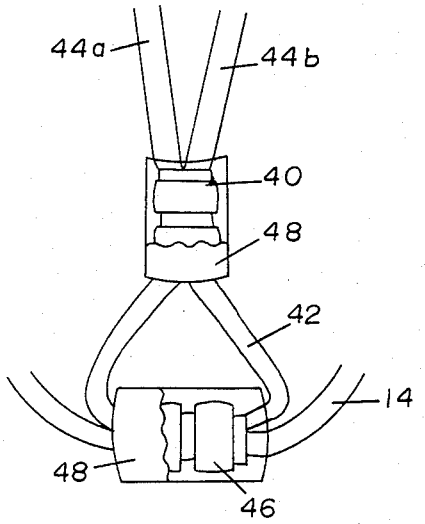
FIG. 4 is an enlarged fragmentary front view of the portion of the control halter where the connecting pieces are attached to the top of the nosepiece.

Referring still to FIG. 3, the connecting mechanism 18 is formed from a unitary length of three-sixteenths inch flexible metal cable with a resilient covering. The length of flexible metal cable is doubled back at its midpoint. Proximate to the midpoint of the length of flexible cable, portions of the flexible cable are drawn together and are secured by a second cable clamp 40. A connecting mechanism loop 42 and right and left connecting pieces 44*a* and 44*b*, respectively, are thus formed. (Right and left in this patent application are defined from the perspective of a rider on the horse.) The connecting mechanism 18 is secured to the uppermost point on the nosepiece 14 by a third cable clamp 46. The third cable clamp 46 secures a portion of the connecting mechanism loop 42 in a parallel relationship with the uppermost portion of the nosepiece 14. As more clearly shown in FIG. 4, both the second cable clamp 40 and the third cable clamp 46 are covered by plastic foam pieces 48 having a cylindrical shape with a bore and being dimensioned to snugly fit about the cable clamps 40 and 46. The plastic foam pieces 48 over the clamp 40 and 46 are shown cut-away. The plastic foam pieces 48 are soft and resilient to prevent abrasion of the horse's nose 15.

As shown in FIG. 3, the right connecting piece 44*a* has a right loop 50 formed from the back turned end of the flexible cable secured by fourth cable clamp 52. Similarly, the left connecting piece 44*b* has a left loop 54 formed from the back turned end of the flexible cable secured by a fifth cable clamp 56. The top portion of the keeper strap 16 is passed through the right loop 50 and left loop 54 to secure the connecting mechanism 18 to the keeper strap 16.

In use, the control halter 12 is fitted over the head of the horse with the nosepiece 14 placed high on the nose 15 of the horse. The right and left connecting pieces 44*a* and 44*b* extend from the nosepiece 14 along the face 20 of the horse with the right connecting piece 44*a* passing over the poll 22 adjacent to the inside of the right ear 57*a* of the horse and the left connecting piece 44*b* passing over the poll 22 adjacent to the left ear 57*b* of the horse. The keeper strap 16 is adjusted using the double-ended strap buckle 38 to fit snugly about the horse's head and neck extending over the poll 22 and underneath the throttle 58 of the horse. The right loop 50 and the left loop 54 may be spaced-apart by moving either along the woven strap 36 to effect the desired placement of the connecting pieces 44*a* and 44*b* over the poll 22. A bridle and bit 30 are placed over the control halter 12 in a conventional fashion. The tie-down 26 is passed between the reins 32 and is attached to the nosepiece loop 24 by means of a conway buckle 28, or by other similar means.

The length of the tie-down 26 is adjusted to achieve the proper head set by changing the position of the conway buckle 28 on the tie-down 26. When the horse lifts its head, the tie-down pulls on the control halter 12 and pressure is applied to the horse's head by the nosepiece 14 and by the connecting pieces 44*a* and 44*b*. Because of the sensitivity of the horse on the poll 22 close to the ears 57*a* and 57*b*, the control halter of the present invention is effective in achieving the proper height for the horse's head.

The connecting pieces 44*a* and 44*b* also apply a downward pressure on the poll 22 of the horse and a downward and backward force on the nose 15 when the horse moves its head forward. This causes an increase in the desired quality of "flexation at the poll", that is, the nose 15 of the horse is pulled further underneath the poll 22. The control halter 12 applies the same amount of pressure to the poll 22 adjacent to the ears 57*a* and 57*b* as it applies high on the nose 15. Thus, the proper flexation at the poll in relation to head height may be achieved.

Because the nosepiece fits loosely about the horse's nose 15, in a high position, the horse is free to turn its head. The horse thus has freedom of nose to run and head control to turn.

Although particular embodiments of the present invention have been described in the foregoing detailed description, it will be understood that the invention is capable of numerous rearrangements, modifications and substitutions of parts without departing from the spirit of the invention.

What is claimed is:

1. A control halter for use in conjunction with a tie-down to develop and maintain a desired head set in a riding horse, comprising:

a loose-fitting nosepiece for loosely encircling the nose of the horse and disposed high on the nose of the horse and having upper and lower portions;

means for connecting the tie-down to said nosepiece;

a keeper strap for being disposed about the horse's head and neck, said keeper strap being dimensioned to extend over the poll and under the throttle of the horse; and two substantially parallel connecting pieces extending between the top of said nosepiece and the top of said keeper strap, each of said connecting pieces being operable to extend along the horse's face and along the inside of one of the horse's ears whereby, said connecting pieces apply the same amount of pressure to the horse's head over the ears and to the nose when the horse raises its head or moves its head forward and the tie-down pulls on said nosepiece, said nosepiece being connected at its upper and lower portions to only said tie-down and said connecting pieces.

2. The control halter of claim 1 wherein said keeper strap comprises:

a woven strap; and a double-edge strap buckle operable to secure said woven strap in a circuitous configuration around the horse's head and neck.

3. The control halter of claim 1, wherein said means for connecting the tie-down to said nosepiece comprises a loop at the lowermost point of said nosepiece for attachment to the tie-down.

4. A control halter having right and left sides for use in conjunction with a tie-down to develop and maintain a desired head set in a riding horse, comprising:

a loose-fitting nosepiece for loosely encircling the nose of the horse and disposed about the nose of the horse in a position high on the nose and having upper and lower portions;

means for fastening said nosepiece to the tie-down;

an adjustable keeper strap for being disposed about the horse's head and neck, said keeper strap being dimensioned to extend over the poll and under the throttle of the horse;

right and left substantially parallel connecting pieces extending from the top of said nosepiece to the top of said keeper strap, said connecting pieces extending from a substantially common position adjacent to the top of said nosepiece to right and left spaced-apart positions on the top of said keeper strap, said right connecting piece extending from said nosepiece along the horse's face and along the inside of the horse's right ear to said right spaced-apart position on said keeper strap, said left connecting piece extending from said nosepiece along the horse's face and along the inside of the horse's left ear to said left spaced-apart position on said keeper strap;

means for fastening said nosepiece to said connecting pieces; and means for fastening said connecting pieces to said keeper strap, said nosepiece being connected at its upper and lower portions to only said tie-down and said connecting pieces.

5. The control halter of claim 4 wherein said adjustable keeper strap comprises:

a woven strap; and a double-edge strap buckle operable to secure said woven strap in a circuitous configuration around the horse's head and neck.

6. The control halter of claim 4, wherein said means for connecting the tie-down to said nosepiece comprises a loop at the lowermost point of said nosepiece for attachment to the tie-down.

7. The control halter of claim 4, wherein said nosepiece and said right and left connecting pieces are made from flexible metal cable having a resilient covering.

8. The control halter of claim 7 wherein said means for fastening said connecting pieces to said keeper strap comprises loops at the ends of said right and left connecting pieces formed from backturned portions of the flexible cable secured by cable clamps, said loops being dimensioned for snugly receiving said keeper strap therethrough.

9. A control halter having right and left sides for use in conjunction with a tie-down to develop and maintain a desired head set in a riding horse, comprising:

a loose-fitting nosepiece for being disposed about the nose of the horse in a position high on the nose;

means for fastening said nosepiece to the tie-down;

an adjustable keeper strap for being disposed about the horse's head and neck, said keeper strap being dimensioned to extend over the poll and under the throttle of the horse;

right and left connecting pieces extending from the top of said nosepiece to the top of said keeper strap, said connecting pieces extending from a substantially common position adjacent to the top of said nosepiece to right and left spaced-apart positions on the top of said keeper strap, said right connecting piece extending from said nosepiece along the horse's face and along the inside of the horse's right ear to said right spaced-apart position on said keeper strap, said left connecting piece extending from said nosepiece along the horse's face and along the inside of the horse's left ear to said left spaced-apart position on said keeper strap;

said connecting pieces being formed from a unitary length of flexible metal cable having a resilient covering, said length of flexible metal cable being doubled back at its midsection and being secured by a first cable clamp along portions of the flexible cable proximate to its midpoint to form a loop;

a cable clamp for securing the lowermost portion of said loop and the uppermost portion of said nosepiece in a substantially parallel relationship;

and means for fastening said connecting pieces to said keeper strap.

10. The control halter of claim 9 further comprising padding over said first and second cable clamps operable to prevent abrasion of the horse's nose.

* * * * *